US009854627B2

(12) United States Patent
Tonomura

(10) Patent No.: US 9,854,627 B2
(45) Date of Patent: Dec. 26, 2017

(54) INDUCTION HEATING SYSTEM

(71) Applicant: TOKUDEN CO., LTD., Kyoto-shi, Kyoto (JP)

(72) Inventor: Toru Tonomura, Otsu (JP)

(73) Assignee: TOKUDEN CO., LTD., Kyoto-shi, Kyoto (JP)

( * ) Notice: Subject to any disclaimer, the term of this patent is extended or adjusted under 35 U.S.C. 154(b) by 0 days.

(21) Appl. No.: 15/074,156

(22) Filed: Mar. 18, 2016

(65) Prior Publication Data

US 2016/0278167 A1 Sep. 22, 2016

(30) Foreign Application Priority Data

Mar. 20, 2015 (JP) ..... 2015-057795

(51) Int. Cl.

| | |
|---|---|
| ***H05B 6/10*** | (2006.01) |
| ***H05B 6/06*** | (2006.01) |
| ***H05B 6/08*** | (2006.01) |
| ***H05B 6/14*** | (2006.01) |
| ***H05B 6/04*** | (2006.01) |
| ***H05B 6/36*** | (2006.01) |

(52) U.S. Cl.

CPC ..... *H05B 6/06* (2013.01); *H05B 6/04* (2013.01); *H05B 6/08* (2013.01); *H05B 6/145* (2013.01); *H05B 6/36* (2013.01)

(58) Field of Classification Search

CPC ... H05B 6/02; H05B 6/04; H05B 6/06; H05B 6/065; H05B 6/08; H05B 6/105; H05B 6/108; H05B 6/145; H05B 6/12; H05B 6/1254; H05B 6/1272; H05B 6/36; H05B 6/365; H05B 6/44

USPC ..... 219/619, 624, 625, 635, 660, 661, 662, 219/672, 628, 629, 630

See application file for complete search history.

(56) References Cited

U.S. PATENT DOCUMENTS 4,647,744 A * 3/1987 Kitano ..... H05B 6/145 219/619

FOREIGN PATENT DOCUMENTS

| | | |
|---|---|---|
| DE | 614190 C | 6/1935 |
| EP | 0585629 | 3/1994 |

(Continued)

OTHER PUBLICATIONS

European Patent Office, Extended European Search Report Issued in Application No. 16160570.4, Aug. 1, 2016, Germany, 8 pages.

*Primary Examiner* — Hung D Nguyen

(74) *Attorney, Agent, or Firm* — Alleman Hall Creasman & Tuttle LLP

(57) ABSTRACT

The present invention intends to run one induction heating apparatus using a three-phase AC power supply without use of a Scott connection transformer while preventing an occurrence of a phase where no current flows. An induction heating system uses the three-phase AC power supply to run the induction heating apparatus including an induction heating coil, and has an intermediate apparatus including a coil that is wound on an iron core with an even number of turns, forming a closed magnetic circuit. Additionally, a winding start point of the induction heating coil is connected to the U phase of the three-phase AC power supply and a winding end point of the same is connected to a midpoint of the intermediate coil. The winding start point and end point of the intermediate coil are connected to the V and W phases of the three-phase AC power supply, respectively.

8 Claims, 4 Drawing Sheets

(56) References Cited

FOREIGN PATENT DOCUMENTS

| | | | | |
|---|---|---|---|---|
| GB | 307044 | | | 12/1929 |
| JP | H03241688 | A | | 10/1991 |
| JP | 6-67651 | A | * | 9/1994 |
| JP | 2001297867 | A | | 10/2001 |
| JP | 2004362791 | | | 12/2004 |

* cited by examiner

INDUCTION HEATING SYSTEM

TECHNICAL FIELD

The present invention relates to an induction heating system adapted to run a single-phase induction heating apparatus using a three-phase power supply.

BACKGROUND ART

An induction coil of an induction heating apparatus causes a reduction in power factor or unevenness in heat generation distribution when magnetic fluxes having different phases intersect with each other within the same magnetic circuit, and is therefore desirably supplied with a single-phase alternating current (AC).

Meanwhile, the power source of an induction heating apparatus is typically a three-phase AC power supply, and therefore, the single-phase AC is usually extracted from the three-phase AC.

Note that when directly connecting an induction heating coil of one induction heating apparatus to, for example, U-V terminals, the induction heating apparatus comes into a state where currents having the same value flow to two (e.g., U and V phases) of the three phases, and no current at all flows to the remaining one phase (e.g., a W phase). That is, the phase current balance among the U, V, and W phases becomes 1:1:0.

Also, as disclosed in Patent Literature 1, there is a method that provides a Scott connection transformer between a three-phase AC power supply and an induction coil to extract single-phase AC outputs for two circuits from the three-phase AC. However, this method requires the Scott connection transformer, and is therefore quite disadvantageous in terms of cost and space.

CITATION LIST

Patent Literature

Patent Literature 1: JP-A2001-297867

SUMMARY OF INVENTION

Technical Problem

Therefore, the present invention is made in order to solve the above-described problem, and a main object thereof is to prevent the occurrence of a phase where no current flows when running one induction heating apparatus using a three-phase AC power supply without the use of a Scott connection transformer.

Solution to Problem

That is, an induction heating system according to the present invention uses a three-phase AC power supply to run a single-phase induction heating apparatus including an induction heating coil, and includes an intermediate apparatus that intervenes between the single-phase induction heating apparatus and the three-phase AC power supply and includes an iron core for forming a closed magnetic circuit and a coil wound on the iron core and having an even number of turns. In addition, one of a winding start point and a winding end point of the induction heating coil is electrically connected to one phase of the three-phase AC power supply, whereas the other one is electrically connected to a midpoint of the coil of the intermediate apparatus, and a winding start point and a winding end point of the coil of the intermediate apparatus are electrically connected to the remaining two phases of the three-phase AC power supply.

This induction heating system is configured such that one of the start and end points of the induction heating coil is electrically connected to one phase of the three-phase AC power supply, whereas the other point is electrically connected to the midpoint of the coil of the intermediate apparatus, and both of the start and end points of the coil of the intermediate apparatus are electrically connected to the remaining two phases of the three-phase AC power supply. As a result, the phase current balance among the U, V, and W phases can be adjusted to 2:1:1. That is, even in the case of running one induction heating apparatus using a three-phase AC power supply without the use of a Scott connection transformer, a state where no current at all flows to one of the three phases can be prevented from occurring. This will be described in detail later.

Desirably, a number of layers formed by the coil of the intermediate apparatus is an even number, the coil of the intermediate apparatus includes two end parts in an axial direction, and the winding start point, the winding end point, and the midpoint of the coil of the intermediate apparatus are each positioned on either of the end parts of the coil.

In this configuration, a current flowing through the induction heating coil enters the midpoint of the coil of the intermediate apparatus, and splits in half, and the split currents flow to the winding start point and the winding end point. Since the current flowing to the winding start point of the coil of the intermediate apparatus and the current flowing to the winding end point of the coil of the intermediate apparatus are opposite in direction, magnetic fluxes generated by the flowing currents cancel each other out and are eliminated. As a result, the voltage between terminals of the coil of the intermediate apparatus only has a power supply voltage component.

Note that by setting the number of layers of the coil of the intermediate apparatus to an even number, and positioning the winding start point, the winding end point, and the midpoint in one end part of the coil or both end parts of the coil, the magnetic coupling between the winding part from the midpoint to the winding start point and the winding part from the midpoint to the winding end point can be improved to efficiently eliminate the magnetic fluxes.

Desirably, a power control device is provided between one end side of the induction heating coil and the three-phase AC power supply.

This configuration makes it possible to control the output of the induction heating apparatus while maintaining the balance among the three-phase currents at 2:1:1.

Desirably, the iron core has a low permeability part having lower permeability than the rest of the iron core.

This configuration reduces the magnetic resistance of the closed magnetic circuit formed by the iron core to increase an excitation current. By adjusting the magnetic resistance so as to obtain a desired excitation current, the three-phase currents can be balanced. The details will be described later.

Desirably, between the induction heating apparatus and the three-phase AC power supply and between the intermediate apparatus and the three-phase AC power supply, three-phase power control devices are provided.

In this configuration, the current flowing through the induction heating coil and the currents flowing through the coil of the intermediate apparatus can be simultaneously controlled to control the output of the induction heating apparatus while maintaining the balance among the three-phase currents obtained by adjusting the magnetic resistance utilizing the low permeability part of the iron core.

Desirably, power control devices are provided between one end side of the induction heating coil and the three-phase AC power supply and between the winding start point or the winding end point of the coil of the intermediate apparatus and the three-phase AC power supply.

This configuration having the two single-phase power control devices in place of the three-phase power control devices makes it possible to control the output of the induction heating apparatus while maintaining the balance among the three-phase currents.

In this configuration, the power control device provided on the one end side of the induction heating coil is feedback controlled on the basis of a load temperature or the like of the induction heating apparatus. On the other hand, since there is no load on the coil of the intermediate apparatus, the power control device provided on the coil side of the intermediate apparatus is controlled in synchronization with the power control device provided on the one end side of the induction heating coil. For example, a possible control method is to make the values of the currents flowing through both coils equal to each other.

The three-phase AC power supply is used in the field of industrial equipment, and an object to be inductively heated is formed of thick metal because it is also used in the field of industrial equipment. For this reason, by setting the power supply frequency of the three-phase AC power supply to a commercial frequency of 50 Hz or 60 Hz, the current penetration depth of the thick metal at the time of inductive heating can be increased to efficiently heat the object.

For an induction heated roll apparatus, the uniformity of a profile (in characteristics) of a roll main body at the time of heating is important, and a single-phase AC is more desirable than a three-phase AC which causes three-phase magnetic fluxes having different phases to intersect with one another in the same roll main body. Also, the roll main body used in the field of industrial equipment is mostly formed of a thick metal. For this reason, desirably, the induction heating apparatus is an induction heated roll apparatus including an induction heated mechanism that has the induction heating coil inside a rotatably supported roll main body.

Advantageous Effects of Invention

According to the present invention configured as described, the occurrence of a phase where no current flows when running one induction heating apparatus using a three-phase AC power supply without the use of a Scott connection transformer can be prevented.

DESCRIPTION OF EMBODIMENTS

In the following, one embodiment of an induction heating system according to the present invention will be described with reference to the drawings.

Figure 1:
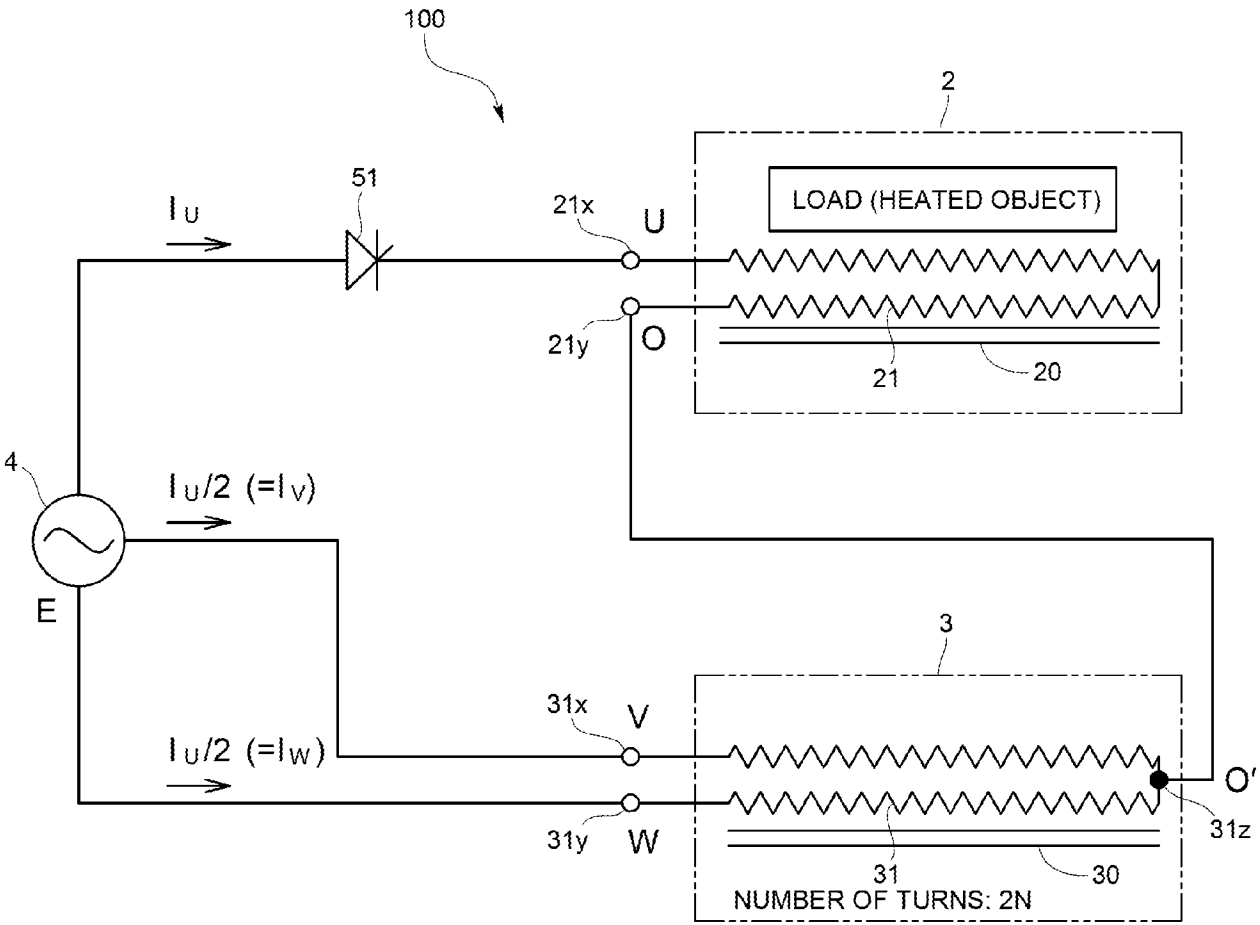
FIG. 1 is a diagram schematically illustrating the configuration of an induction heating system according to the present embodiment.
Figure 2:
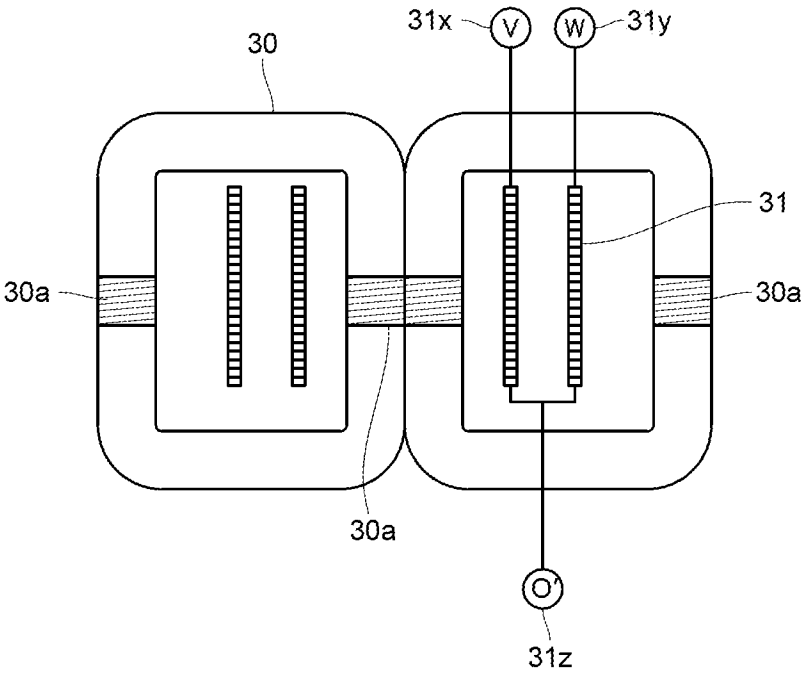
FIG. 2 is a diagram schematically illustrating the configuration of an intermediate apparatus in a variation.

As shown in FIG. 1, an induction heating system 100 according to the present embodiment runs a single-phase induction heating apparatus 2 (hereinafter simply referred to as an induction heating apparatus 2) using a three-phase AC power supply 4, and an intermediate apparatus 3 other than the induction heating apparatus is provided intervening between the induction heating apparatus 2 and the three-phase AC power supply 4.

The intermediate apparatus 3 includes an iron core 30 for forming a closed magnetic circuit, and a coil 31 (hereinafter referred to as an intermediate coil 31) wound on the iron core 30.

The induction heating apparatus 2 has an induction heating coil 21, and the induction heating coil 21 is provided wound on an iron core 20. As the induction heating apparatus 2, for example, a fluid heating apparatus that uses the induction heating coil 21 as a primary coil, and thereby inductively heats a conductive tube as a secondary coil wound on the iron core 20 to heat fluid flowing through the conductive tube, is possible. In this case, the induction heating apparatus 2 may be a saturated steam generator adapted to heat water to generate saturated steam, or a superheated steam generator adapted to heat saturated steam to generate superheated steam. In addition, as the induction heating apparatus 2, an induction heated roll apparatus including an induction heated mechanism having an induction coil 21 inside a rotatably supported roll main body is possible.

Also, the power supply frequency of the three-phase AC power supply 4 is a commercial frequency of 50 Hz or 60 Hz. This makes it possible to increase the current penetration depth of thick metal such as a conductive tube at the time of induction heating to efficiently heat an object.

In addition, a winding start point 21*x* of the induction heating coil 21 is electrically connected to the U phase of the three-phase AC power supply 4, and a winding end point 21*y* of the induction heating coil 21 is electrically connected to the midpoint 31*z* of the intermediate coil 31. Further, a winding start point 31*x* of the intermediate coil 31 is electrically connected to the V phase of the three-phase AC power supply 4, and a winding end point 31*y* of the intermediate coil 31 is electrically connected to the W phase of the three-phase AC power supply 4.

In the present embodiment, the winding start and end points 21*x*, 21*y*, 31*x*, and 31*y* of the respective coils 21 and 31 are provided with connecting terminals. Also, the midpoint 31*z* of the intermediate coil 31 is provided with a connecting terminal.

Further, the intermediate coil 31 is configured such that the number of turns is an even number (2N (N is a natural number)). That is, the number of turns from the midpoint 31*z* to the winding start point 31*x* of the intermediate coil 31 is N, and the number of turns from the midpoint 31*z* to the winding end point 31*y* is also N.

In the present embodiment, the number of layers of the intermediate coil 31 is set to an even number. For example, in the case where the intermediate coil 31 is configured to have two layers, it is configured that the winding start point 31*x* and the winding end point 31*y* are positioned on one axial direction end side of the intermediate coil 31, and the midpoint 31*z* is positioned on the other axial direction end side of the intermediate coil 31.

Further, between one end part of the induction heating coil 21 and the three-phase AC power supply 4, a power control device 51 that controls a current flowing through the induction heating coil 21 is provided. In the present embodiment, the power control device 51 is provided between the winding start point 21$x$ of the induction heating coil 21 and the three-phase AC power supply 4 (U phase). Note that the power control device 51 is a semiconductor control element such as a thyristor. The power control device 51 is controlled by an unillustrated control part.

Next, currents flowing through the respective phases of the induction heating system 100 configured as described will be described with reference to FIG. 1. In addition, in the following, the capacity of the induction heating apparatus is denoted by P, the power supply voltage of the three-phase AC power supply 4 by E, and the three-phase currents by $I_U$, $I_V$, and $I_W$.

Given that the voltage between the terminals of the induction heating coil is denoted by $E_{U\text{-}O}$, $E_{U\text{-}O}=\sqrt{3}E/2$.

The current flowing through the induction heating coil is equal to $I_U$, and $I_U=2P/(\sqrt{3}E)$.

The voltage between the terminals of the intermediate coil is equal to the power supply voltage, which is E.

Each of the currents flowing through the intermediate coil is $I_V=I_W=\{P/(\sqrt{3}E)\}+I_0$.

Here, $I_0$ is an excitation current that generates magnetic flux flowing through the closed magnetic circuit, and addition is represented by a vector sum. However, the value of the excitation current is sufficiently small because of the closed magnetic circuit, and therefore it is acceptable to assume $I_V=I_W\approx\{P/(\sqrt{3}E)\}$.

Accordingly, the three-phase current ratio is given by:

$$I_U:I_V:I_W=2P/(\sqrt{3}E):P/(\sqrt{3}E):P/(\sqrt{3}E)=2:1:1.$$

In the induction heating system 100 configured as described, since the winding start point 21$x$ of the induction heating coil 21 is electrically connected to the U phase of the three-phase AC power supply 4 and the winding end point 21$y$ of the induction heating coil 21 is electrically connected to the midpoint 31$z$ of the intermediate coil 31, and the winding start point 31$x$ and the winding end point 31$y$ of the intermediate coil 31 are electrically connected to the V and W phases of the three-phase AC power supply 4, respectively, the intermediate apparatus 3 functions as a current balancing apparatus, and therefore the phase current balance among the U, V, and W phases can be adjusted to 2:1:1. That is, even in the case of running the one induction heating apparatus 2 using the three-phase AC power supply 4 without the use of a Scott connection transformer, a state where no current at all flows to one of the three phases can be prevented from occurring.

Also, since the power control device 51 is provided between the one end side (the winding start point 21$x$) of the induction heating coil 21 and the three-phase AC power supply 4, it is possible to control the output of the induction heating apparatus 2 while maintaining the balance among the three-phase currents at 2:1:1.

Note that the present invention is not limited to the above-described embodiment.

For example, the iron core 30 of the intermediate apparatus 3 may have a low permeability part 30$a$ having lower permeability than that of the rest of the iron core 30 to reduce the magnetic resistance of the closed magnetic circuit as compared with the iron core 30 not having the lower permeability part 30$a$. The low permeability part 30$a$ is formed of an insulator resistible to the temperature rises of the iron core 30 and the coil 31, such as a silicon glass laminated sheet or an aramid board. In addition, the rest other than the lower permeability part 30$a$ serves as a high permeability part formed of an electromagnetic steel sheet or amorphous metal.

Decreasing the magnetic resistance by inserting the low permeability part 30$a$ into the closed magnetic circuit increases the excitation current $I_0$ flowing through the iron core 30. From vector operations, $$I_V=I_U/2+I_0 \quad \text{(vector sum)}$$

and $$I_0=I_V-I_U/2 \quad \text{(vector difference).}$$

By adjusting the magnetic resistance such that $I_0$ meets the above expressions, the three-phase currents are balanced.

Figure 3:
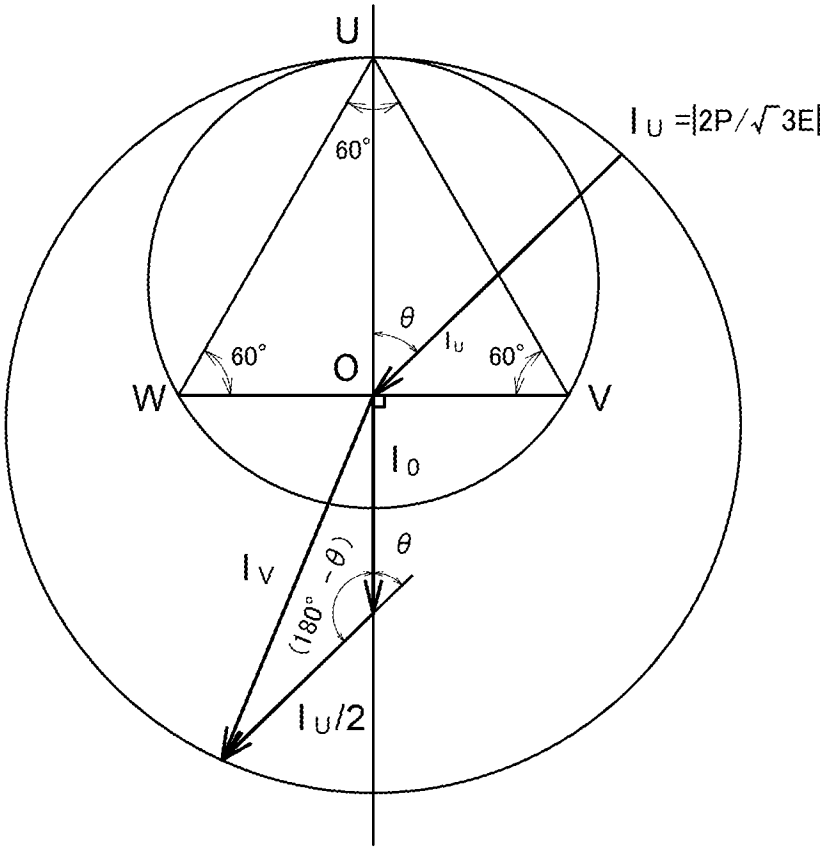
FIG. 3 is a current vector diagram in the variation.
Figure 4:
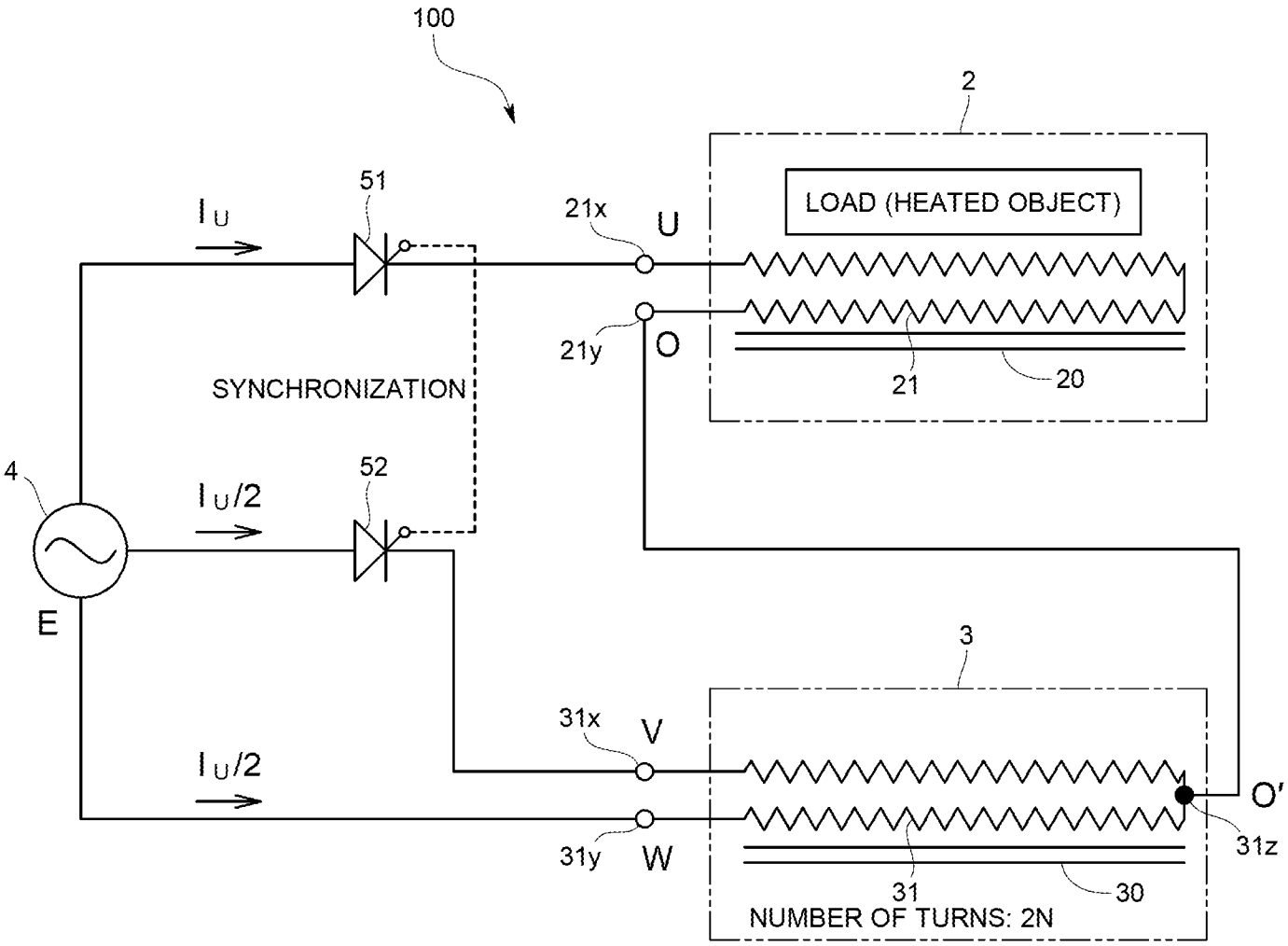
FIG. 4 is a diagram schematically illustrating the configuration of an induction heating system according to another variation.

FIG. 3 is a diagram illustrating current vectors.

The current flowing through the induction heating coil 21 has a power factor, and the value of the power factor is denoted by cos Θ. $I_0$ basically has a 90° delayed phase.

Performing an absolute value calculation in accordance with the cosine theorem in the triangle $I_0$-$I_V$-O in FIG. 3 gives:

$$I_V^2=I_0^2+(I_U/2)^2-I_0I_U\cos(180°-\Theta)$$

$$(2P/\sqrt{3}E)^2=I_0^2+(P/\sqrt{3}E)^2-2I_0P\cos(180°-\Theta)/\sqrt{3}E$$

$$I_0^2-2I_0P\cos(180°-\Theta)/\sqrt{3}E-(2P/\sqrt{3}E)^2+(P/\sqrt{3}E)^2=0$$

$$I_0=P\cos(180°-\Theta)/\sqrt{3}E\pm[\sqrt{[\{-2P\cos(180°-\Theta)/\sqrt{3}E\}^2-4\{(2P/\sqrt{3}E)^2-(P/\sqrt{3}E)^2\}]}]/2.$$

Simplifying this expression gives:

$$I_0=P[\cos(180°-\Theta)+\sqrt{\{\cos^2(180°-\Theta)+3\}}]/\sqrt{3}E.$$

By adjusting the magnetic resistance of the closed circuit such that $I_0$ meets this expression, the three-phase currents can be balanced. Note that the ± sign in the original expression is treated as follows: a practical and appropriate sign is selected, and in this case, the plus sign is employed.

Also, in terms of power control, in addition to the above-described embodiment, a power control device 52 may be provided between the winding start point 31$x$ or winding end point 31$y$ of the intermediate coil 31 of the intermediate apparatus 3 and the three-phase AC power supply 4. In this case, the power control device 51 provided on the one end side of the induction heating coil 21 is feedback controlled on the basis of a load temperature or the like of the induction heating apparatus 2. On the other hand, since there is no load on the coil 31 of the intermediate apparatus 3, the power control device 52 provided on the coil 31 side of the intermediate apparatus 3 is controlled in synchronization with the power control device 51 provided on the induction heating coil 21 side.

Further, three-phase power control devices may be provided between the induction heating apparatus 2 and the intermediate apparatus 3, and the three-phase AC power supply 4.

In addition, it will be appreciated that the present invention is not limited to any of the above-described embodiment and variations, but can be variously modified without departing from the scope thereof.

LIST OF REFERENCE CHARACTERS

100 Induction heating system
2 Single-phase induction heating apparatus
21 Induction heating coil
21$x$ Winding start point of induction heating coil
21$y$ Winding end point of induction heating coil
3 Intermediate apparatus
30 Closed magnetic circuit iron core

31 Coil
31*x* Winding start point of coil
31*y* Winding end point of coil
31*z* Midpoint of coil
4 Three-phase AC power supply
51 Power control device
52 Power control device

The invention claimed is:

1. An induction heating system that uses a three-phase AC power supply to run a single-phase induction heating apparatus including an induction heating coil, the induction heating system comprising:

an intermediate apparatus that intervenes between the single-phase induction heating apparatus and the three-phase AC power supply and includes an iron core for forming a closed magnetic circuit that is different from a closed magnetic circuit formed in the single-phase induction heating apparatus and a coil wound on the iron core and having an even number of turns, the intermediate apparatus being different from and provided separately from the single-phase induction heating apparatus, wherein:

one of a winding start point and a winding end point of the induction heating coil is electrically connected to one phase of the three-phase AC power supply, and the other one is electrically connected to a midpoint of the coil of the intermediate apparatus; and a winding start point and a winding end point of the coil of the intermediate apparatus are electrically connected to the remaining two phases of the three-phase AC power supply.

2. The induction heating system according to claim 1, wherein:

a number of layers formed by the coil of the intermediate apparatus is an even number;

the coil of the intermediate apparatus includes two end parts in an axial direction; and the winding start point, the winding end point, and the midpoint of the coil of the intermediate apparatus are each positioned on either of the end parts of the coil.

3. The induction heating system according to claim 1, wherein a power control device is provided between one end side of the induction heating coil and the three-phase AC power supply.

4. The induction heating system according to claim 1, wherein the iron core has a low permeability part having lower permeability than the rest of the iron core.

5. The induction heating system according to claim 4, wherein three-phase power control devices are provided between the induction heating apparatus and the three-phase AC power supply and between the intermediate apparatus and the three-phase AC power supply.

6. The induction heating system according to claim 4, wherein power control devices are provided between one end side of the induction heating coil and the three-phase AC power supply and between the winding start point or the winding end point of the coil of the intermediate apparatus and the three-phase AC power supply.

7. The induction heating system according to claim 1, wherein a power supply frequency of the three-phase AC power supply is 50 Hz or 60 Hz.

8. The induction heating system according to claim 1, wherein the induction heating apparatus is an induction heated roll apparatus including an induction heated mechanism that has the induction heating coil inside a rotatably supported roll main body.

* * * * *